US011041290B2

(12) United States Patent
Kodaka et al.

(10) Patent No.: US 11,041,290 B2
(45) Date of Patent: Jun. 22, 2021

(54) LOCKING SYSTEM FOR A WORK MACHINE

(71) Applicant: Hitachi Construction Machinery Co., Ltd., Tokyo (JP)

(72) Inventors: Katsuaki Kodaka, Ibaraki (JP); Ryohei Fukuchi, Ibaraki (JP); Kazuhiko Mizoguchi, Ibaraki (JP); Naoki Hagiwara, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/979,423

(22) PCT Filed: Sep. 26, 2019

(86) PCT No.: PCT/JP2019/038009
§ 371 (c)(1),
(2) Date: Sep. 9, 2020

(87) PCT Pub. No.: WO2020/067366
PCT Pub. Date: Apr. 2, 2020

(65) Prior Publication Data

US 2021/0079624 A1 Mar. 18, 2021

(30) Foreign Application Priority Data

Sep. 27, 2018 (JP) ..... JP2018-181967

(51) Int. Cl.
*E02F 9/22* (2006.01)
*E02F 9/12* (2006.01)
(Continued)

(52) U.S. Cl.
CPC ..... *E02F 9/226* (2013.01); *E02F 9/128* (2013.01); *E02F 9/2004* (2013.01);
(Continued)

(58) Field of Classification Search
CPC . E02F 9/2296; E02F 9/226; E02F 9/24; E02F 9/26; F15B 2211/8643; F15B 15/26
See application file for complete search history.

(56) References Cited

U.S. PATENT DOCUMENTS 5,632,190 A * 5/1997 Sunamura ..... E02F 9/226 91/459
8,098,128 B2 * 1/2012 Arakawa ..... B60R 25/2018 340/5.2
(Continued)

FOREIGN PATENT DOCUMENTS

JP 5-1436 A 1/1993
JP WO 2013/179517 A1 12/2013
(Continued)

OTHER PUBLICATIONS

International Search Report (PCT/ISA/210) issued in PCT Application No. PCT/JP2019/038009 dated Dec. 17, 2019 with English translation (four pages).
(Continued)

*Primary Examiner* — Thomas E Lazo
(74) *Attorney, Agent, or Firm* — Crowell & Moring LLP

(57) ABSTRACT

To provide a work machine that can stop unexpected operation of actuators faster than it actually occurs even if unintended operation occurs at the time of gate lock lever switching that leads to such unexpected operation. In the work machine, a controller switches a lock valve from a lock position to a release position in a case where a lock operation device is operated from a permission position to a prohibition position; decides, on the basis of a result of detection by a pressure sensor, whether or not a pilot hydraulic fluid has been output from a pilot valve until first time elapses after the lock valve is switched to the release position; keeps the lock valve at the lock position if it is decided that the pilot hydraulic fluid has been output until the first time elapses;
(Continued)

and switches the lock valve from the lock position to the release position if it is decided that the pilot hydraulic fluid has not been output until the first time elapses, and second time elapses.

6 Claims, 5 Drawing Sheets

(51) Int. Cl.

| | |
|---|---|
| ***E02F 9/20*** | (2006.01) |
| ***E02F 9/24*** | (2006.01) |
| ***E02F 9/26*** | (2006.01) |
| ***F15B 15/02*** | (2006.01) |
| ***F15B 15/20*** | (2006.01) |
| ***F15B 15/26*** | (2006.01) |
| *E02F 3/43* | (2006.01) |

(52) U.S. Cl.
CPC ..... *E02F 9/2033* (2013.01); *E02F 9/2203* (2013.01); *E02F 9/2267* (2013.01); *E02F 9/2271* (2013.01); *E02F 9/2285* (2013.01); *E02F 9/24* (2013.01); *E02F 9/26* (2013.01); *F15B 15/02* (2013.01); *F15B 15/204* (2013.01); *F15B 15/26* (2013.01); *E02F 3/435* (2013.01); *E02F 9/2292* (2013.01); *E02F 9/2296* (2013.01); *F15B 2211/857* (2013.01)

(56) References Cited

U.S. PATENT DOCUMENTS

| | | | | |
|---|---|---|---|---|
| 8,833,068 | B2 * | 9/2014 | Himoto | F15B 20/00 60/459 |
| 8,880,302 | B1 * | 11/2014 | Tachibana | E02F 3/435 701/50 |
| 2012/0000191 | A1 * | 1/2012 | Hagiwara | E02F 9/2246 60/311 |
| 2014/0060026 | A1 | 3/2014 | Himoto et al. | |
| 2019/0360172 | A1 * | 11/2019 | Yamamoto | E02F 9/2296 |

FOREIGN PATENT DOCUMENTS

| | | | |
|---|---|---|---|
| JP | 5467176 | B1 | 4/2014 |
| JP | WO 2015/011832 | A1 | 1/2015 |
| WO | WO 2018/155567 | A1 | 8/2018 |

OTHER PUBLICATIONS

Japanese-language Written Opinion (PCT/ISA/237) issued in PCT Application No. PCT/JP2019/038009 dated Dec. 17, 2019 (three pages).

* cited by examiner

LOCKING SYSTEM FOR A WORK MACHINE

TECHNICAL FIELD

The present invention relates to a work machine capable of switching via a gate lock lever whether it is allowed to operate actuators.

BACKGROUND ART

Patent Literature 1 describes a work vehicle that enables prevention of unexpected operation of actuators due to unintended operation at the time of gate lock lever switching. The work vehicle described in Patent Literature 1 switches a lock valve from a locked state to a released state if a lock member is switched from a lock position to a release position, and switches the lock valve to the locked state in a case where a pilot pressure has become equal to or higher than a predetermined pressure in a predetermined length of time after the lock member is switched to the release position.

CITATION LIST

Patent Literature

PATENT LITERATURE 1: Japanese Patent No. 5467176

SUMMARY OF INVENTION

Technical Problem

In the work vehicle described in Patent Literature 1, whether or not unintended operation has occurred is detected while the lock valve is kept in the released state, and the lock valve is switched to the locked state again after unintended operation is detected. However, an inertial force is applied to an actuator having started operating, and so there is a possibility that even if the lock valve is switched to the locked state, the actuator does not stop immediately.

The present invention has been contrived in view of the circumstance described above, and an object thereof is to provide a work machine that can stop unexpected operation of actuators faster than it actually occurs even if unintended operation occurs at the time of gate lock lever switching that leads to such unexpected operation.

Solution to Problem

In order to achieve the object, in a work machine of the present invention including: an engine; a hydraulic pump driven by the engine; an actuator driven by a hydraulic fluid delivered by the hydraulic pump; a directional control valve that is provided between the hydraulic pump and the actuator, and controls an operation direction of the actuator and a speed of the actuator; an actuator operation device that operates the actuator; a pilot valve that outputs, to the directional control valve and as an operation signal, a pilot pressure according to an operation amount of the actuator operation device; a lock operation device that can be operated to a permission position for permitting an entrance of an operator to an operator's seat, and a prohibition position for prohibiting an entrance of the operator to the operator's seat; a lock valve that is switched to a lock position for interrupting a supply of the hydraulic fluid to the pilot valve in a case where the lock operation device is operated to the permission position, and is switched to a release position for supplying the hydraulic fluid to the pilot valve in a case where the lock operation device is operated to the prohibition position; a pressure sensor that detects the pilot pressure; and a controller that controls a switch position of the lock valve, the controller switches the lock valve from the lock position to the release position in a case where the lock operation device is operated from the permission position to the prohibition position; decides, on the basis of a result of the detection by the pressure sensor, whether or not a pilot hydraulic fluid has been output from the pilot valve until first time elapses after the lock valve is switched to the release position; keeps the lock valve at the lock position if it is decided that the pilot hydraulic fluid has been output until the first time elapses; and switches the lock valve from the lock position to the release position if it is decided that the pilot hydraulic fluid has not been output until the first time elapses, and second time elapses.

Advantageous Effects of Invention

According to the present invention, it is possible to stop unexpected operation of actuators faster than it actually occurs even if unintended operation occurs at the time of gate lock lever switching that leads to such unexpected operation. Note that problems, configurations and effects other than those described above are made apparent by the following explanation of an embodiment.

DESCRIPTION OF EMBODIMENT

Figure 1:
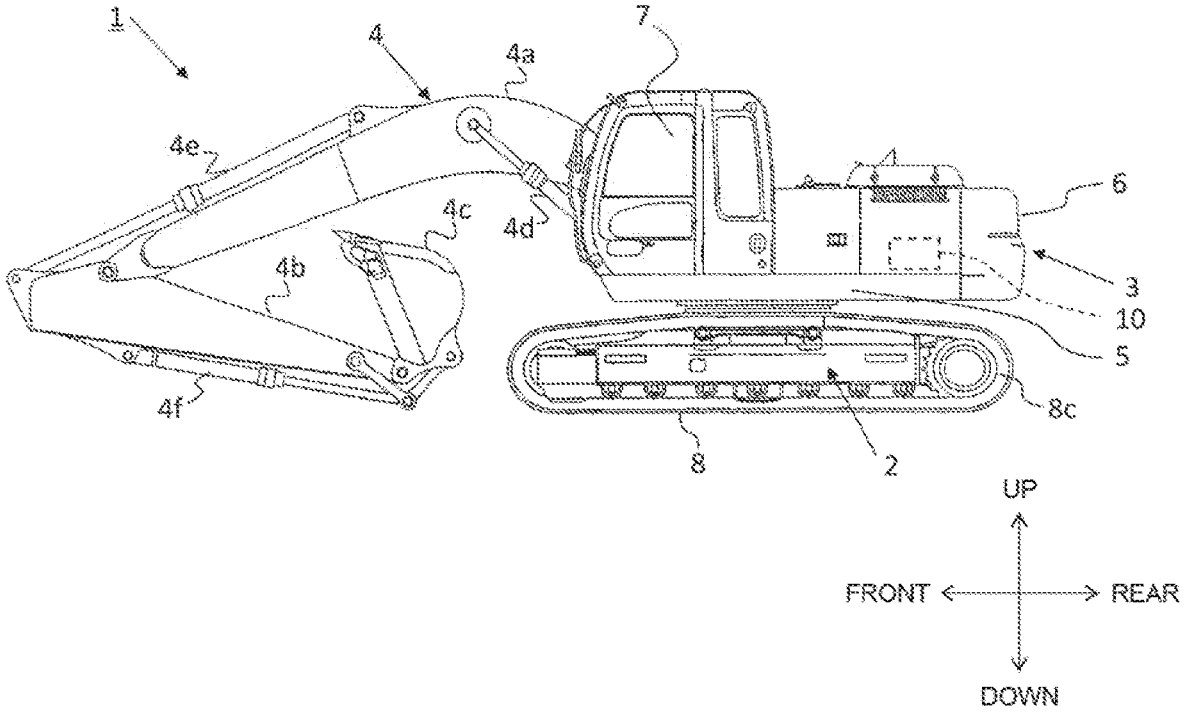
FIG. 1 is a side view of a hydraulic excavator that is a representative example of a work machine according to the present invention.
Figure 2:
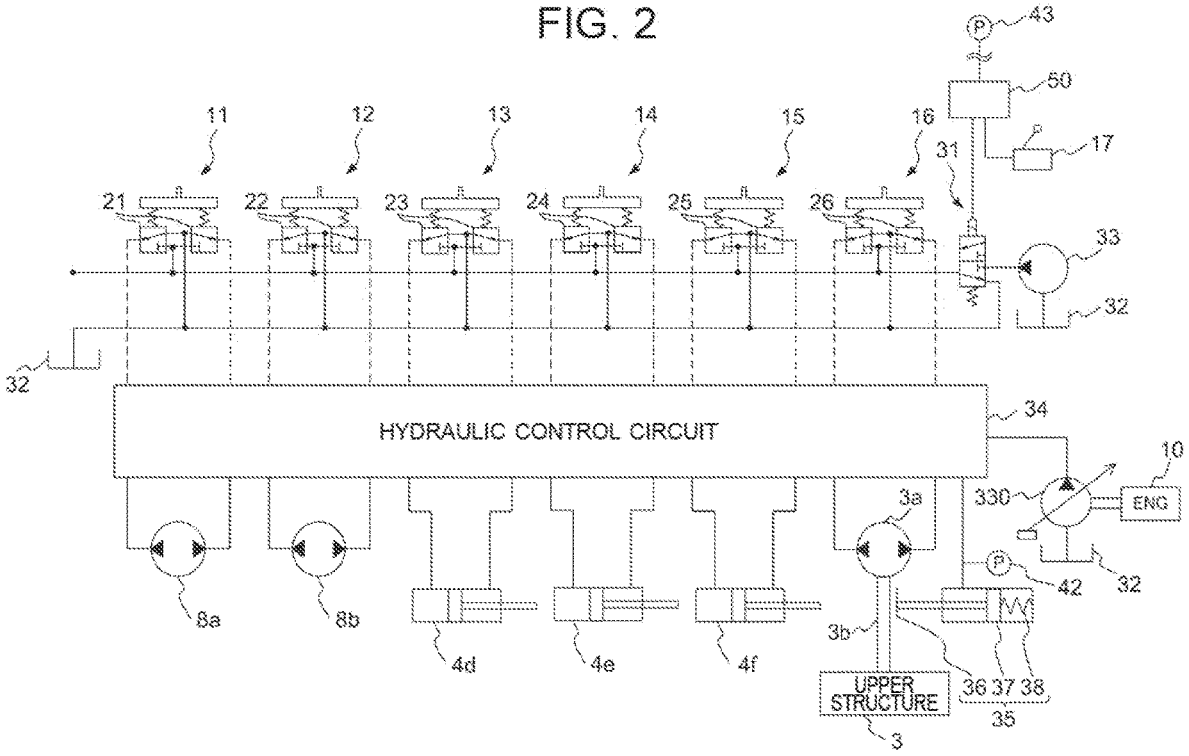
FIG. 2 is a figure illustrating the schematic configuration of a hydraulic circuit included in the hydraulic excavator.

An embodiment of a work machine according to the present invention is explained by using the drawings. FIG. 1 is a side view of a hydraulic excavator 1 that is a representative example of a work machine according to the present invention. FIG. 2 is a figure illustrating the schematic configuration of a hydraulic circuit included in the hydraulic excavator 1. Note that unless otherwise noted particularly, the front, rear, left and right directions in the present specification are relative to the viewpoint of an operator who gets on, and operates the hydraulic excavator 1. In addition, specific examples of the work machine are not limited to the hydraulic excavator 1, but may be a dump truck, a motor grader, a wheel loader, and the like.

The hydraulic excavator 1 includes a undercarriage 2, and an upperstructure 3 supported by the undercarriage 2. The undercarriage 2 includes a pair of left and right crawlers 8. The pair of left and right crawlers 8 rotate independently by driving wheels 8*c* driven by hydraulic motors 8*a* and 8*b* (see FIG. 2). Thereby, the hydraulic excavator 1 can move forward and backward, and make turns.

The upperstructure 3 is supported by the undercarriage 2 such that the upperstructure 3 can be swung by a swing motor 3*a* (see FIG. 2). The upperstructure 3 includes: a swing frame 5 that serves as a base; a cab (operator's seat) 7 arranged on the front left side of the swing frame 5; a front work device 4 attached vertically rotatably to the middle on the front side of the swing frame 5; a counter weight 6 arranged on the rear side of the swing frame 5; and an engine 10 that generates drive force for operating the hydraulic excavator 1.

The front work device 4 includes: a boom 4*a* supported by the upperstructure 3 such that the boom 4*a* can face upward and downward; an arm 4*b* supported by the tip of the boom 4*a* such that the arm 4*b* can oscillate; a bucket 4*c* supported by the tip of the arm 4*b* such that the bucket 4*c* can oscillate; and hydraulic cylinders (actuators) 4*d* to 4*f* that drive the boom 4*a*, the arm 4*b*, and the bucket 4*c*. That is, the boom 4*a* is directly supported by the upperstructure 3, and the arm 4*b* and the bucket 4*c* are indirectly supported by the upperstructure 3. The counter weight 6 is for counterbalancing the weight of the front work device 4, and is an arc-shaped heavy object.

The cab 7 has an internal space formed therein. An operator who operates the hydraulic excavator 1 gets in the internal space. The internal space of the cab 7 has operation devices (a steering, pedals, levers, switches, etc.) arranged therein. The operator operates the operation devices to give instructions to operate the hydraulic excavator 1. That is, by the operation devices being operated by the operator who got in the cab 7, the hydraulic excavator 1 is operated. The operation devices include actuator operation devices for causing the undercarriage 2 to travel, swinging the upperstructure 3 and operating the front work device 4, and lock operation devices that lock and unlock operation of the hydraulic excavator 1.

As illustrated in FIG. 2, the actuator operation devices include: travel levers (travel operation devices) 11 and 12 that operate the pair of left and right crawlers 8, respectively; a boom lever 13 that operates the boom 4*a*; an arm lever 14 that operates the arm 4*b*; a bucket lever 15 that operates the bucket 4*c*; and a swing lever 16 that swings the upperstructure 3. The lock operation devices include a gate lock lever 17 that switches the position of a lock valve 31 mentioned below.

Note that the forms of the actuator operation devices, and the lock operation devices are not limited to lever forms, but may be steering forms, pedal forms, switch forms, button forms, or the like. In addition, in the following explanation, the boom lever 13, the arm lever 14, the bucket lever 15, and the swing lever 16 are in some cases collectively denoted as "work levers 13 to 16."

The actuator operation devices are connected to pilot valves 21, 22, 23, 24, 25 and 26. The pilot valves 21 to 26 output hydraulic fluids pressurized and fed by a hydraulic pump (pilot pump) 33 driven by the engine 10 from a hydraulic fluid tank 32 to a hydraulic control circuit 34 as pilot hydraulic fluids for operating the corresponding actuators 3*a*, 4*d* to 4*f*, and 8*a* to 8*b*. The flow rates of the pilot hydraulic fluids change in accordance with operation amounts of corresponding actuator control devices. The pressures (pilot pressures) of the pilot hydraulic fluids are one example of operation signals.

More specifically, the pilot valves 21 and 22 output pilot hydraulic fluids for driving the hydraulic motors 8*a* and 8*b* in accordance with operation amounts of the travel levers 11 and 12. The pilot valve 23 outputs a pilot hydraulic fluid for driving the boom cylinder 4*d* in accordance with an operation amount of the boom lever 13. The pilot valve 24 outputs a pilot hydraulic fluid for driving the arm cylinder 4*e* in accordance with an operation amount of the arm lever 14. The pilot valve 25 outputs a pilot hydraulic fluid for driving the bucket cylinder 4*f* in accordance with an operation amount of the bucket lever 15. The pilot valve 26 outputs a pilot hydraulic fluid for driving the swing motor 3*a* in accordance with an operation amount of the swing lever 16.

The gate lock lever 17 is configured such that an operator can switch the gate lock lever 17 to a permission position for restricting operation of the actuators 3*a*, 4*d* to 4*f*, and 8*a* to 8*b*, and permitting an entrance of the operator to the cab 7, and a prohibition position for permitting operation of the actuators 3*a*, 4*d* to 4*f*, and 8*a* to 8*b*, and prohibiting an entrance of the operator to the cab 7. The gate lock lever 17 outputs, to a controller 50 (see FIG. 3), a release signal when the gate lock lever 17 is at the prohibition position, for example.

The gate lock lever 17 is arranged between the entrance and seat of the cab 7, for example. Then, the gate lock lever 17 may be configured such that when the gate lock lever 17 is at the permission position, the operator is not prevented from getting in or out of the cab 7, and when the gate lock lever 17 is at the prohibition position, the operator is prevented from getting in or out of the cab 7. Thereby, it is possible to lower the possibility that an operator leaves the cab 7 while keeping the gate lock lever 17 at the prohibition position.

The hydraulic control circuit 34 supplies, to the actuators 3*a*, 4*d* to 4*f*, and 8*a* to 8*b*, a hydraulic fluid delivered by a hydraulic pump 330 driven by the engine 10 in accordance with the pilot hydraulic fluids supplied from the pilot valves 21 to 26. The hydraulic control circuit 34 includes directional control valves that are provided between the hydraulic pump 33, and the actuators 3*a*, 4*d* to 4*f*, and 8*a* to 8*b*, for example, and switch the supply amounts and supply directions of the hydraulic fluid in accordance with the pilot hydraulic fluids. A plurality of the directional control valves are provided corresponding to the individual actuators 3*a*, 4*d* to 4*f*, and 8*a* to 8*b*, control the speeds of the corresponding actuators 3*a*, 4*d* to 4*f*, and 8*a* to 8*b* in accordance with the supply amount of the hydraulic fluid, and control the operation directions of the corresponding actuator 3*a*, 4*d* to 4*f*, and 8*a* to 8*b* in accordance with the supply direction of the hydraulic fluid. The specific configuration of the hydraulic control circuit 34 is already well-known, and so detailed explanation is omitted.

The lock valve 31 is a solenoid valve switched to a lock position and a release position in accordance with control by the controller 50. When the lock valve 31 is at the lock position, the supply of the hydraulic fluid from the hydraulic pump 33 to the pilot valves 21 to 26 is interrupted. On the other hand, when the lock valve 31 is at the release position, the supply of the hydraulic fluid from the hydraulic pump 33 to the pilot valves 21 to 26 is permitted. The lock valve 31 is configured such that, for example, the lock valve 31 is initially at the lock position, and the lock valve 31 is switched to the release position only while a release signal is being output from the gate lock lever 17, and returns to the lock position if the output of the release signal is stopped.

That is, when the gate lock lever 17 is at the permission position (the lock valve 31 is at the lock position), no pilot hydraulic fluids are output from the pilot valve 21 to 26 even if an actuator operation device is operated. In other words, when the gate lock lever 17 is at the permission position (the lock valve 31 is at the lock position), the actuators 3*a*, 4*d* to 4*f*, and 8*a* to 8*b* are not driven even if an actuator operation device is operated.

On the other hand, when the gate lock lever 17 is at the prohibition position (the lock valve 31 is at the release position), a pilot hydraulic fluid is output from the pilot valve 21 to 26 if an actuator operation device is operated. That is, when the gate lock lever 17 is at the prohibition position (the lock valve 31 is at the release position), the actuators 3*a*, 4*d* to 4*f*, and 8*a* to 8*b* are driven in accordance with operation of an actuator operation device.

The hydraulic control circuit 34 is connected with a swing brake 35 that restricts and permits the swing of the upperstructure 3. The swing brake 35 includes, for example, a brake pad 36 that brakes a rotation axis 3*b* of the upperstructure 3, and a cylinder 37 that makes the brake pad 36 in and out of contact with the rotation axis 3*b*. The swing brake 35 is configured such that, by a parking release hydraulic fluid supplied from the hydraulic control circuit 34, the swing brake 35 can be switched to a state where it restricts the swing of the upperstructure 3 and to a state where it permits the swing of the upperstructure 3.

The cylinder 37 restricts the swing of the upperstructure 3 by causing the brake pad 36 to abut against the rotation axis 3*b* by using the urging force of a coil spring 38 that is one example of an urging member. In addition, if the cylinder 37 receives, at the rod chamber, the supply of the parking release hydraulic fluid from the hydraulic control circuit 34, the cylinder 37 separates the brake pad 36 from the rotation axis 3*b* against the urging force of the coil spring 38, and permits the swing of the upperstructure 3. Furthermore, if the cylinder 37 stops receiving the supply of the parking release hydraulic fluid from the hydraulic control circuit 34, the cylinder 37 causes the brake pad 36 to abut against the rotation axis 3*b* again by using the urging force of the coil spring 38, and restricts the swing of the upperstructure 3.

The swing brake 35 is a so-called negative brake that prevents an unintended swing of the upperstructure 3 while the hydraulic excavator 1 is stopped. On the other hand, if the upperstructure 3 or the front work device 4 is operated while the swing of the upperstructure 3 is restricted, the upperstructure 3 receives an excessive load. In view of this, when the upperstructure 3 or the front work device 4 is operated, the swing brake 35 needs to be released.

In view of this, the hydraulic control circuit 34 supplies the parking release hydraulic fluid to the cylinder 37 while the gate lock lever 17 is at the prohibition position, and at least one of the work levers 13 to 16 is being operated (i.e. while the pilot hydraulic fluid is being output from at least one of the pilot valves 23 to 26). That is, the swing brake 35 permits the swing of the upperstructure 3 while the pilot hydraulic fluid is being supplied from at least one of the pilot valves 23 to 26.

On the other hand, the hydraulic control circuit 34 stops the supply of the parking release hydraulic fluid while the gate lock lever 17 is at the permission position or while the gate lock lever 17 is at the prohibition position, and none of the work levers 13 to 16 is being operated (i.e. while the pilot hydraulic fluid is not output from any of the pilot valves 23 to 26). That is, the swing brake 35 restricts the swing of the upperstructure 3 while the pilot hydraulic fluid is not output from any of the pilot valves 23 to 26.

In addition, in order to release the swing brake 35 before the upperstructure 3 or the front work device 4 actually starts moving, the hydraulic control circuit 34 starts supplying the parking release hydraulic fluid to the cylinder 37 immediately before the hydraulic fluid starts being supplied to the actuators 3*a*, and 4*d* to 4*f*. That is, if the work levers 13 to 16 are operated, the swing brake 35 is released immediately before the upperstructure 3 or the front work device 4 starts operating.

Figure 3:
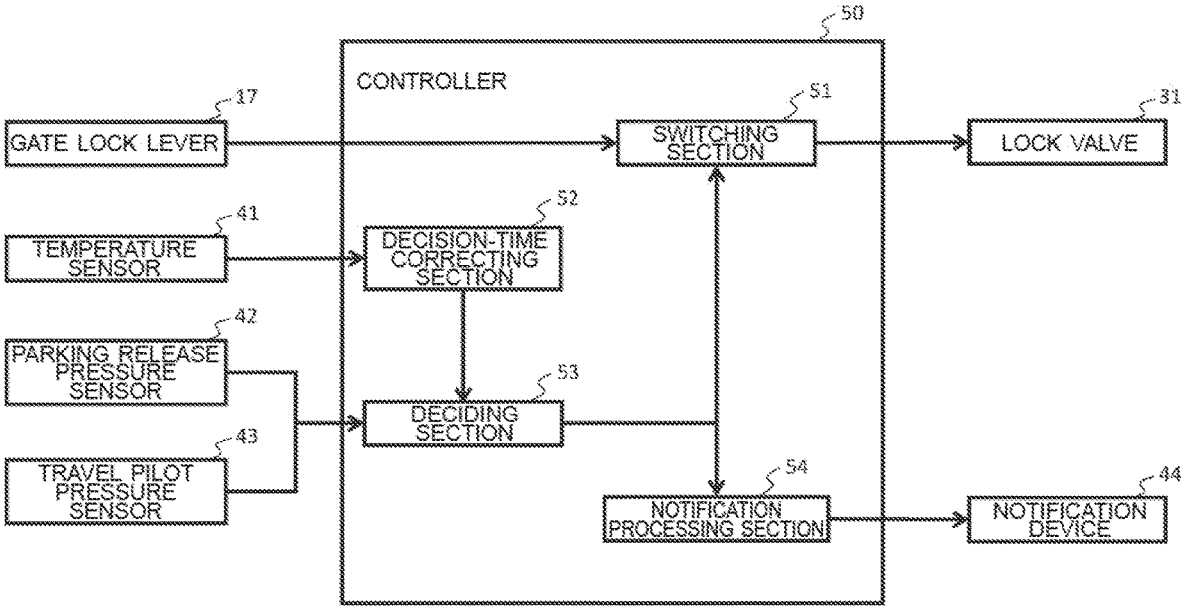
FIG. 3 is a block diagram illustrating the configuration of a controller included in the hydraulic excavator.

Next, the configuration of the controller 50 is explained with reference to FIG. 3. FIG. 3 is a block diagram illustrating the configuration of the controller 50 included in the hydraulic excavator 1. The controller 50 acquires various types of signal output from the gate lock lever 17, a temperature sensor 41, a parking release pressure sensor 42, and a travel pilot pressure sensor 43, and controls the lock valve 31 and a notification device 44 on the basis of the acquired various types of signal.

For example, the temperature sensor 41 measures the temperature of the hydraulic fluid stored in the hydraulic fluid tank 32, and outputs a temperature signal indicating the temperature acquired through the measurement to the controller 50. The parking release pressure sensor 42 measures the pressure of the parking release hydraulic fluid supplied to the cylinder 37, and outputs a pressure signal indicating the pressure acquired through the measurement to the controller 50. The travel pilot pressure sensor 43 measures the pressures of the pilot hydraulic fluid output from the pilot valves 21 and 22, and outputs pressure signals indicating the pressures acquired through the measurement to the controller 50.

It is assumed that pressure sensors that detect pilot pressures in the present invention include pressure sensors that detect pilot pressures according to operation amounts of the boom lever 13, the arm lever 14, the bucket lever 15, and the swing lever 16, in addition to the parking release pressure sensor 42 and the travel pilot pressure sensor 43.

The notification device 44 is a device that notifies various types of information to an operator who gets on the cab 7. Although specific examples of the notification device 44 are not limited particularly, for example, the notification device 44 is a display that displays characters, images and videos, for example, a warning light, or a speaker that outputs sounds.

Although an illustration is omitted, the controller 50 includes a CPU (Central Processing Unit), a ROM (Read Only Memory), and a RAM (Random Access Memory). It should be noted, however, that the specific configuration of the controller 50 is not limited to this, and the controller 50 may be realized by hardware such as an ASIC (Application Specific Integrated Circuit) or a FPGA (Field-Programmable Gate Array).

By the CPU reading out program codes stored on the ROM, and executing them, the controller 50 functions as a switching section 51, a decision-time correcting section 52, a deciding section 53, and a notification processing section 54 through cooperation between software and hardware. In addition, the RAM is used as a work area when the CPU executes the program.

The switching section 51 controls the switch position of the lock valve 31. More specifically, in a case where the gate lock lever 17 is operated from the permission position for permitting an entrance of an operator into the operator's seat to the prohibition position for prohibiting an entrance of an operator into the operator's seat, the lock valve 31 is switched to the lock position for interrupting the supply of the pilot hydraulic fluid or to the release position for permitting the supply of the pilot hydraulic fluid on the basis of results from the deciding section 53 mentioned below, and also the lock valve 31 is switched to the release position or the lock position on the basis of results from the deciding section 53 mentioned below also in a case where the gate lock lever 17 is operated from the prohibition position to the permission position.

In addition, the switching section 51 switches the lock valve 31 from the release position to the lock position in response to a lapse of first time $t_1$ after the lock valve 31 is switched to the release position. Furthermore, after the lock valve 31 is switched to the lock position after the elapse of the first time $t_1$, the switching section 51 switches the lock valve 31 again from the lock position to the release position in response to a notification from the deciding section 53 that there is no unintended operation.

On the basis of a temperature signal output from the temperature sensor 41, the decision-time correcting section 52 corrects the value of the first time $t_1$, and notifies the corrected first time $t_1$ to the switching section 51 and the deciding section 53. The initial value of the first time $t_1$ is 0.2 seconds, for example. Then, the decision-time correcting section 52 increases the first time $t_1$ to be set, as the temperature of the hydraulic fluid indicated by the temperature signal lowers. This is because due to an increase of the viscosity of the hydraulic fluid that accompanies lowering of the temperature, the rising of the parking release pressure $P_1$, and the travel pilot pressure $P_2$ mentioned below becomes slower.

The deciding section 53 decides whether or not the actuator operation devices 11 to 16 are operated until the first time $t_1$ elapses after the lock valve 31 is switched to the release position (operation at this timing is denoted "unintended operation"). In other words, the deciding section 53 decides whether or not the pilot hydraulic fluid is output from at least one of the pilot valves 21 to 26 until the first time $t_1$ elapses after the lock valve 31 is switched to the release position. Then, the deciding section 53 notifies results of the decision to the switching section 51 and the notification processing section 54.

Note that typical examples of "unintended operation" in the present embodiment include operation of the gate lock lever 17 from the permission position to the prohibition position while the actuator operation devices 11 to 16 are being operated. For example, it can be assumed that an operator operates the gate lock lever 17 while the operator does not notice that his/her body hits the actuator operation devices 11 to 16 and the actuator operation device 11 to 16 are being operated.

As one example, the deciding section 53 decides that unintended operation has occurred in a case where the parking release pressure $P_1$ indicated by a pressure signal output from the parking release pressure sensor 42 becomes equal to or higher than a first threshold $P_{th1}$ until the first time $t_1$ elapses after the lock valve 31 is switched to the release position. On the other hand, the deciding section 53 decides that unintended operation has not occurred in a case where the parking release pressure $P_1$ stayed lower than the first threshold $P_{th1}$ until the first time $t_1$ elapses after the lock valve 31 is switched to the release position. Note that the first threshold $P_{th1}$ is set to a value (e.g. 1 MPa) that is sufficiently lower than a parking release pressure $P_{pk}$ (e.g. 4 MPa) necessary for releasing the swing brake 35.

As another example, the deciding section 53 decides that unintended operation has occurred in a case where the travel pilot pressure $P_2$ indicated by a pressure signal output from the travel pilot pressure sensor 43 becomes equal to or higher than a second threshold $P_{th2}$ until the first time $t_1$ elapses after the lock valve 31 is switched to the release position. On the other hand, the deciding section 53 decides that unintended operation has not occurred in a case where the travel pilot pressure $P_2$ stayed lower than the second threshold $P_{th2}$ until the first time $t_1$ elapses after the lock valve 31 is switched to the release position. Note that the second threshold $P_{th2}$ is set to a value (e.g. 0.6 MPa) that is sufficiently lower than a travel pilot pressure $P_{tv}$ (e.g. up to 4 MPa) output from the pilot valves 21 and 22 at the time of operation of the travel levers 11 and 12.

In response to a decision by the deciding section 53 that unintended operation has occurred, the notification processing section 54 gives, through the notification device 44: a notification that unintended operation has occurred; a notification that the lock valve 31 is switched to the lock position in response to sensing of the occurrence of the unintended operation; a notification about how to switch the lock valve 31 from the lock position to the release position; or the like. That is, the notification processing section 54 may cause a display to display messages, turn on (flash) a warning light or cause a speaker to output sounds, for example.

Figure 4:
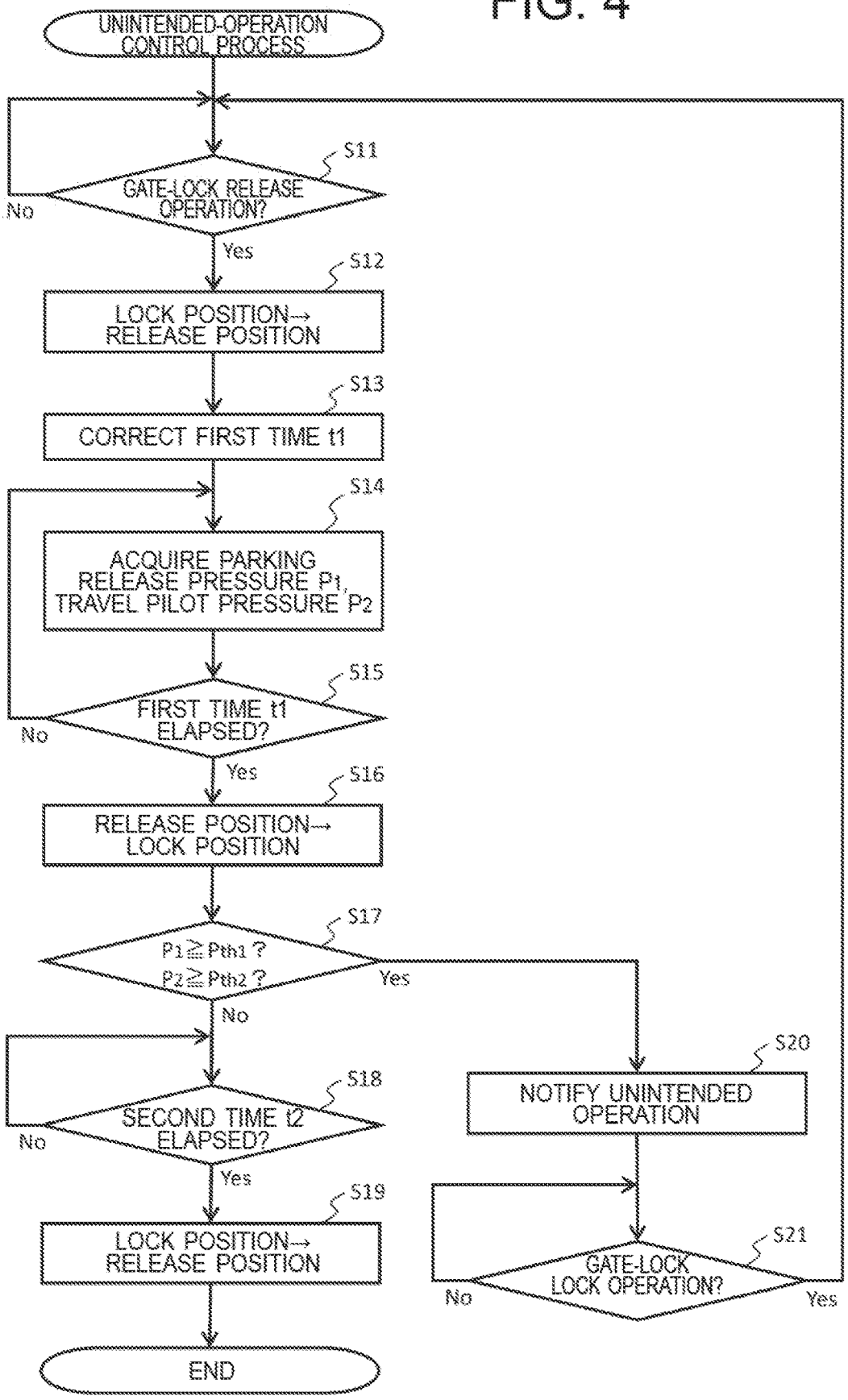
FIG. 4 is a flowchart of an unintended-operation control process executed by the controller.
Figure 5:
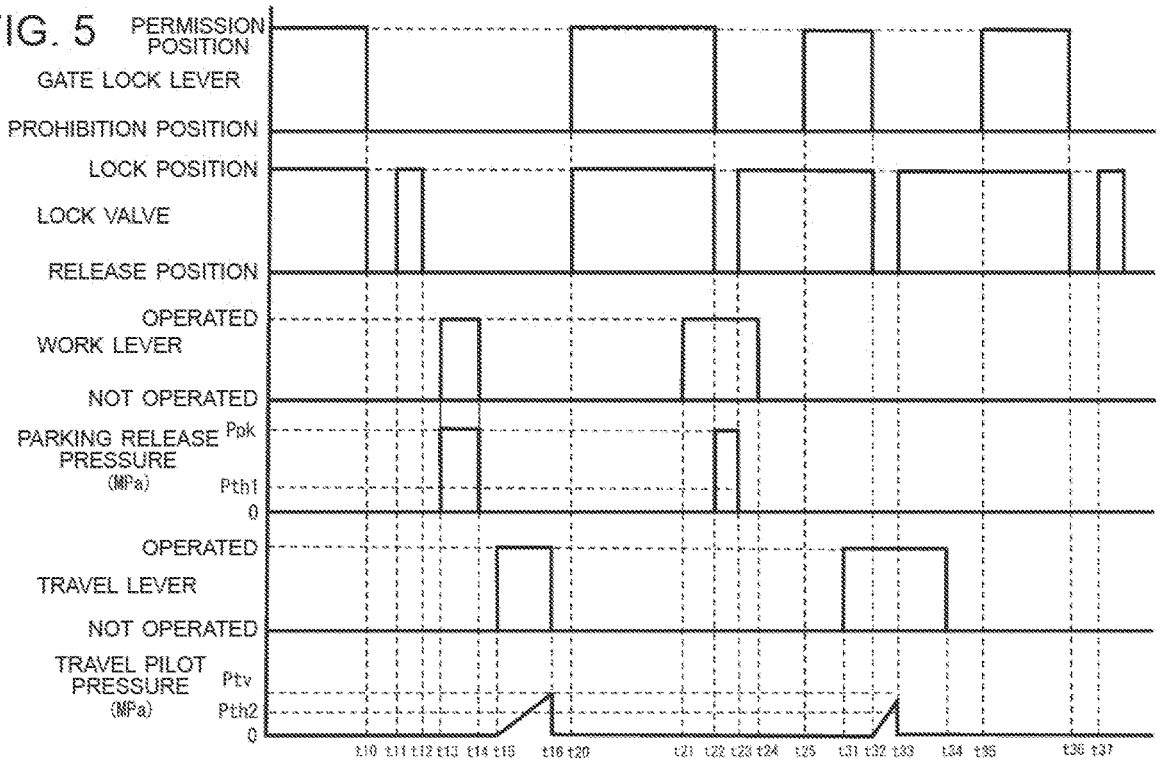
FIG. 5 is a time chart illustrating temporal changes of the position of a gate lock lever, the position of a lock valve, operation of work levers, a parking release pressure, operation of travel levers, and a travel pilot pressure.

Next, a process of the controller 50 is explained with reference to FIG. 4 and FIG. 5. FIG. 4 is a flowchart of an unintended-operation control process executed by the controller 50. FIG. 5 is a time chart illustrating temporal changes of the position of the gate lock lever 17, the position of the lock valve 31, whether or not the work levers 13 to 16 are operated, the parking release pressure, whether or not the travel levers 11 and 12 are operated, and the travel pilot pressure. Note that it is assumed that the gate lock lever 17 is at the permission position and the lock valve 31 is at the lock position at the time point of the start of the unintended-operation control process.

First, the switching section 51 monitors whether the gate lock lever 17 is operated from the permission position to the prohibition position (release operation) (S11). In response to an output of a release signal from the gate lock lever 17 at time $t_{10}$ in FIG. 5, the switching section 51 determines that the gate lock lever 17 is operated from the permission position to the prohibition position. Then, in response to the operation of the gate lock lever 17 from the permission position to the prohibition position (S11: Yes), the switching section 51 switches the lock valve 31 from the lock position to the release position (S12).

Next, on the basis of a temperature signal output from the temperature sensor 41, the decision-time correcting section 52 corrects the first time $t_1$ (S13). The specific method of correcting the first time $t_1$ is not particularly limited. For example, a table, a graph, a function or the like indicating the relationship between temperature and the first time $t_1$ is stored on the ROM, and the first time $t_1$ corresponding to the temperature indicated by the temperature signal may be acquired. Then, the decision-time correcting section 52 notifies the corrected first time $t_1$ to the switching section 51 and the deciding section 53.

Next, until the first time $t_1$ elapses after the gate lock lever 17 is operated to the prohibition position (S15: No), the deciding section 53 monitors the values of the parking release pressure $P_1$ and the travel pilot pressure $P_2$ (S14). More specifically, the deciding section 53 repetitively executes a process of acquiring the parking release pressure $P_1$ indicated by a pressure signal of the parking release pressure sensor 42, and storing the acquired parking release pressure $P_1$ on the RAM. Similarly, the deciding section 53 repetitively executes a process of acquiring the travel pilot pressure $P_2$ indicated by a pressure signal of the travel pilot pressure sensor 43, and storing the acquired travel pilot pressure $P_2$ on the RAM.

Next, in response to a lapse of the time $t_1$ after the gate lock lever 17 is operated to the prohibition position (time $t_{11}$ has come in FIG. 5) (S15: Yes), the switching section 51 switches the lock valve 31 from the release position to the lock position (S16). At this time, the gate lock lever 17 is kept at the prohibition position. That is, irrespective of the position of the gate lock lever 17, the switching section 51 switches the lock valve 31 to the lock position at Step S16.

In addition, in response to a lapse of the time $t_1$ after the gate lock lever 17 is operated to the prohibition position (S15: Yes), the deciding section 53 compares the parking release pressure $P_1$ stored on the RAM with the first threshold $P_{th1}$, and compares the travel pilot pressure $P_2$ stored on the RAM with the second threshold $P_{th2}$ (S17). The first threshold $P_{th1}$ and the second threshold $P_{th2}$ are values predetermined through experiments, simulations or the like, for example, and are stored on the ROM.

Between time $t_{10}$ and time $t_{11}$ in FIG. 5, the parking release pressure $P_1$ and the travel pilot pressure $P_2$ stay at 0 MPa, and so the deciding section 53 decides that the parking release pressure $P_1$ is lower than the first threshold $P_{th1}$, and the travel pilot pressure $P_2$ is lower than the second threshold $P_{th2}$ (S17: No). That is, the deciding section 53 decides that unintended operation has not occurred between time $t_{10}$ and time $t_{11}$. Then, the deciding section 53 notifies the switching section 51 and the notification processing section 54 of results of the decision that unintended operation has not occurred.

Next, in response to the decision by the deciding section 53 that unintended operation has not occurred between time $t_{10}$ and time $t_{11}$ (S17: No), until second time $t_2$ elapses (S18: No), the switching section 51 waits without executing processes at and after Step S19. The second time $t_2$ is a predetermined length of time, for example, and is 0.2 seconds, for example. Note that the first time $t_1$ and the second time $t_2$ may have the same value or may have different values.

Then, in response to a lapse of the second time $t_2$ from time $t_{11}$ (time $t_{12}$ has come in FIG. 5) (S18: Yes), the switching section 51 switches the lock valve 31 from the lock position to the release position (S19). On the other hand, in a case where the deciding section 53 decides that unintended operation has not occurred between time $t_{10}$ and time $t_{11}$, the notification processing section 54 may not execute any particular process.

Thereafter, if the work levers 13 to 16 are operated between time $t_{13}$ and time $t_{14}$, the parking release pressure $P_1$ is detected, and the actuators 3*a* and 4*d* to 4*f* corresponding to the operated work levers 13 to 16 are driven. In addition, if the travel levers 11 and 12 are operated between time $t_{15}$ and time $t_{16}$, the travel pilot pressure $P_2$ is detected, and the actuators 8*a* and 8*b* corresponding to the travel levers 11 and 12 are driven.

Next, if the operator operates the gate lock lever 17 from the prohibition position to the permission position at time $t_{20}$ in FIG. 5, the switching section 51 switches the lock valve 31 from the release position to the lock position. Then, the switching section 51 returns to Step S11 again, and monitors whether the gate lock lever 17 is operated from the permission position to the prohibition position (S11).

Next, even if the operator operates the work levers 13 to 16 at time $t_{21}$ in FIG. 5, the pilot hydraulic fluid is not output from the pilot valves 23 to 26 because the lock valve 31 is at the lock position, and also the parking release pressure $P_1$ is not detected at the parking release pressure sensor 42. Note that it is assumed in this example that the state where the work levers 13 to 16 are operated continues from time $t_{21}$ to time $t_{24}$.

Next, if the operator operates the gate lock lever 17 from the permission position to the prohibition position at time $t_{22}$ in FIG. 5 (S11: Yes), the switching section 51 switches the lock valve 31 to the release position (S12), the decision-time correcting section 52 corrects the first time $t_1$ (S13), the deciding section 53 monitors the parking release pressure $P_1$ and the travel pilot pressure $P_2$ until the first time $t_1$ elapses (S14), and, in response to a lapse of the first time $t_1$, the switching section 51 switches the lock valve 31 to the lock position (S15).

If the lock valve 31 is switched to the lock position at time $t_{23}$ in FIG. 5, the parking release pressure $P_1$ is no longer detected even if the work levers 13 to 16 remain being operated. Explanation of the processes of Steps S12 to S15 is similar to previously mentioned explanation, and so is not presented again.

If the gate lock lever 17 is operated to the prohibition position at time $t_{22}$ while the work levers 13 to 16 are being operated, the parking release pressure $P_1$ is detected by the parking release pressure sensor 42. Accordingly, the deciding section 53 decides that the parking release pressure $P_1$ has become equal to or higher than the first threshold $P_{th1}$ during the first time $t_1$ (between time $t_{22}$ and time $t_{23}$), and notifies the switching section 51 and the notification processing section 54 of results of the decision that unintended operation has occurred (S17: Yes).

Next, in response to the decision by the deciding section 53 that unintended operation has occurred between time $t_{22}$ and time $t_{23}$ (S17: Yes), the notification processing section 54 notifies the occurrence of the unintended operation through the notification device 44 (S20).

On the other hand, in response to the decision by the deciding section 53 that unintended operation has occurred between time $t_{22}$ and time $t_{23}$ (S17: Yes), the switching section 51 does not execute the processes of Steps S18 to S19, but monitors whether the gate lock lever 17 is operated from the prohibition position to the permission position (lock operation) (S21). That is, the lock valve 31 is kept at the lock position. Then, even if the second time $t_2$ elapses from time $t_{23}$ or operation of the work levers 13 to 16 ends at time $t_{24}$, the lock valve 31 is kept at the lock position.

Next, in response to operation of the gate lock lever 17 from the prohibition position to the permission position at time $t_{25}$ in FIG. 5 (S21: Yes), the switching section 51 returns to Step S11 again, and monitors whether the gate lock lever 17 is operated from the permission position to the prohibition position (S11). It should be noted, however, that the lock valve 31 is already at the lock position, and so the switching section 51 does not need to switch the lock valve 31.

Next, even if the operator operates the travel levers 11 and 12 at time $t_{31}$ in FIG. 5, the pilot hydraulic fluid is not output from the pilot valves 21 and 22 because the lock valve 31 is at the lock position, and also the travel pilot pressure $P_2$ is not detected at the travel pilot pressure sensor 43. Note that it is assumed in this example that the state where the travel levers 11 and 12 are operated continues from time $t_{31}$ to time $t_{34}$.

Next, if the operator operates the gate lock lever 17 from the permission position to the prohibition position at time $t_{32}$ in FIG. 5 (S11: Yes), the switching section 51 switches the lock valve 31 to the release position (S12), the decision-time correcting section 52 corrects the first time $t_1$ (S13), the deciding section 53 monitors the parking release pressure $P_1$ and the travel pilot pressure $P_2$ until the first time $t_1$ elapses (S14), and, in response to a lapse of the first time $t_1$, the switching section 51 switches the lock valve 31 to the lock position (S15).

If the lock valve 31 is switched to the lock position at time $t_{32}$ in FIG. 5, the travel pilot pressure $P_2$ is no longer detected even if the travel levers 11 and 12 remain being operated. Explanation of the processes of Steps S12 to S15 is similar to previously mentioned explanation, and so is not presented again.

If the gate lock lever 17 is operated to the prohibition position at time $t_{32}$ while the travel levers 11 and 12 are being operated, the travel pilot pressure $P_2$ is detected by the travel pilot pressure sensor 43. Accordingly, the deciding section 53 decides that the travel pilot pressure $P_2$ has become equal to or higher than the second threshold $P_{th2}$ during the first time $t_1$ (between time $t_{32}$ and time $t_{33}$), and notifies the switching section 51 and the notification processing section 54 of results of the decision that unintended operation has occurred (S17: Yes).

Note that if the gate lock lever 17 is operated to the prohibition position while the work levers 13 to 16 are being operated as illustrated in FIG. 5, the parking release pressure $P_1$ rises instantaneously to 6 MPa; on the contrary, if the gate lock lever 17 is operated to the prohibition position while the travel levers 11 and 12 are being operated, the travel pilot pressure $P_2$ rises slowly. Accordingly, the first time $t_1$ is desirably set longer than a length of time necessary for the travel pilot pressure $P_2$ to rise from 0 MPa to the second threshold $P_{th2}$ (0.6 MPa).

Next, in response to the decision by the deciding section 53 that unintended operation has occurred between time $t_{32}$ and time $t_{33}$ (S17: Yes), the notification processing section 54 notifies the occurrence of the unintended operation through the notification device 44 (S20).

On the other hand, in response to the decision by the deciding section 53 that unintended operation has occurred between time $t_{32}$ and time $t_{33}$ (S17: Yes), the switching section 51 does not execute the processes of Steps S18 to S19, but monitors whether the gate lock lever 17 is operated from the prohibition position to the permission position (S21). That is, the lock valve 31 is kept at the lock position. Then, even if the second time $t_2$ elapses from time $t_{33}$ or operation of the travel levers 11 and 12 ends at time $t_{34}$, the lock valve 31 is kept at the lock position.

Next, in response to operation of the gate lock lever 17 from the prohibition position to the permission position at time $t_{35}$ in FIG. 5 (S21: Yes), the switching section 51 returns to Step S11 again, and monitors whether the gate lock lever 17 is operated from the permission position to the prohibition position (S11). It should be noted, however, that the lock valve 31 is already at the lock position, and so the switching section 51 does not need to switch the lock valve 31. Explanation of the subsequent processes is similar to previously mentioned explanation, and so is not presented again.

The embodiment described above provides the following action and effects, for example.

In the embodiment described above, if the gate lock lever 17 is operated to the prohibition position, the lock valve 31 is switched to the release position only for the first time $t_1$, and whether or not unintended operation has occurred is decided until the first time $t_1$ elapses. Then, if unintended operation has not occurred, the lock valve 31 is switched to the release position, and if unintended operation has occurred, the lock valve 31 is kept at the lock position. Thereby, as compared with a case where whether or not unintended operation has occurred is decided with the lock valve 31 being kept at the release position, and the lock valve 31 is switched to the lock position if it is decided that unintended operation has occurred, it is possible to stop unexpected operation of the actuators 3*a*, 4*d* to 4*f*, and 8*a* to 8*b* faster.

In addition, as the temperature lowers, the viscosity of the hydraulic fluid becomes higher, and so the rising of the travel pilot pressure $P_2$ in particular becomes slower. In view of this, by making longer the time (first time) $t_1$ for a decision about the travel pilot pressure $P_2$ at Steps S14 to S15 as the temperature of the hydraulic fluid lowers as in the embodiment described above, it is possible to decide fast whether or not unintended operation has occurred.

In addition, according to the embodiment described above, whether or not unintended operation of the work levers 13 to 16 has occurred is decided on the basis of the parking release pressure $P_1$. The parking release pressure $P_1$ rises no matter which of the work levers 13 to 16 is operated. Accordingly, by detecting the parking release pressure $P_1$ at the parking release pressure sensor 42, the number of sensors can be reduced as compared with a case where a sensor is provided for each of the pilot valves 23 to 26. In addition, the rising of a detection signal of the parking release pressure $P_1$ is faster (the parking release pressure $P_1$ rises instantaneously) as compared with the rising of a detection signal of the pilot pressure due to operation of the work levers 13 to 16, and so whether or not unintended operation of the work lever 13 to 16 has occurred can be decided more promptly and surely. As a result, for example, it is possible to prevent more surely the upperstructure 3 from rotating due to inertia.

In addition, according to the embodiment described above, an occurrence of unintended operation is notified through the notification device 44 (S20). Furthermore, according to the embodiment described above, in a case where it is decided that unintended operation has occurred, in order to switch the lock valve 31 to the release position again, the operator needs to operate the gate lock lever 17 to the permission position once (S21: Yes), and to the prohibition position again (S11: Yes). By causing the operator to execute such a procedure, it is possible to make the operator aware of the occurrence of the unintended operation. As a result, it is possible to expect that the gate lock lever 17 is operated to the prohibition position after the unintended operation is dealt with.

The embodiment mentioned above is illustrated for the purpose of explaining the present invention, and it is not intended to limit the scope of the present invention only to the embodiment. Those skilled in the art can implement the present invention in various other aspects without deviating from the gist of the present invention.

REFERENCE SIGNS LIST

1 . . . hydraulic excavator,
2 . . . undercarriage,
3 . . . upperstructure,
3*a* . . . swing motor,
4 . . . front work device,
4*a* . . . boom,
4*b* . . . arm,
4*c* . . . bucket,
4*d* . . . boom cylinder,
4*e* . . . arm cylinder,
4*f* . . . bucket cylinder,
5 . . . swing frame,
6 . . . counter weight,

7 . . . cab,
8 . . . crawler,
8*a*, 8*b* . . . hydraulic motor,
8*c* . . . driving wheel,
10 . . . engine,
11, 12 . . . travel lever (travel operation device),
13 . . . boom lever,
14 . . . arm lever,
15 . . . bucket lever,
16 . . . swing lever,
17 . . . gate lock lever (lock operation device),
21, 22, 23, 24, 25, 26 . . . pilot valve,
31 . . . lock valve,
32 . . . hydraulic fluid tank,
33 . . . hydraulic pump,
34 . . . hydraulic control circuit,
35 . . . swing brake,
36 . . . brake pad,
37 . . . cylinder,
38 . . . coil spring,
41 . . . temperature sensor,
42 . . . parking release pressure sensor,
43 . . . travel pilot pressure sensor,
44 . . . notification device,
50 . . . controller,
51 . . . switching section,
52 . . . decision-time correcting section,
53 . . . deciding section,
54 . . . notification processing section

The invention claimed is:

1. A work machine comprising:
an engine;
a hydraulic pump driven by the engine;
an actuator driven by a hydraulic fluid delivered by the hydraulic pump;
a directional control valve that is provided between the hydraulic pump and the actuator, and controls an operation direction of the actuator and a speed of the actuator;
an actuator operation device that operates the actuator;
a pilot valve that outputs, to the directional control valve and as an operation signal, a pilot pressure according to an operation amount of the actuator operation device;
a lock operation device that can be operated to a permission position for permitting an entrance of an operator to an operator's seat, and a prohibition position for prohibiting an entrance of the operator to the operator's seat;
a lock valve that is switched to a lock position for interrupting a supply of the hydraulic fluid to the pilot valve in a case where the lock operation device is operated to the permission position, and is switched to a release position for supplying the hydraulic fluid to the pilot valve in a case where the lock operation device is operated to the prohibition position;
a pressure sensor that detects the pilot pressure; and
a controller that controls a switch position of the lock valve,
wherein the controller
switches the lock valve from the lock position to the release position in a case where the lock operation device is operated from the permission position to the prohibition position;
decides, on the basis of a result of the detection by the pressure sensor, whether or not a pilot hydraulic fluid has been output from the pilot valve until first time elapses after the lock valve is switched to the release position;
keeps the lock valve at the lock position if it is decided that the pilot hydraulic fluid has been output until the first time elapses; and
switches the lock valve from the lock position to the release position if it is decided that the pilot hydraulic fluid has not been output until the first time elapses, and second time elapses.

2. The work machine according to claim 1, comprising a temperature sensor that detects a temperature of the hydraulic fluid supplied to the pilot valve,
wherein the controller increases the first time to be set, as the temperature detected by the temperature sensor becomes lower.

3. The work machine according to claim 1,
wherein the actuator includes a first actuator and a second actuator directly or indirectly supported by a swingable upperstructure,
the actuator operation device includes:
a first operation device that operates the first actuator; and
a second operation device that operates the second actuator,
the pilot valve includes:
a first pilot valve that outputs, to the directional control valve and as an operation signal, the pilot hydraulic fluid according to an operation amount of the first operation device; and
a second pilot valve that outputs, to the directional control valve and as an operation signal, the pilot hydraulic fluid according to an operation amount of the second operation device,
the work machine includes a swing brake that restricts a swing of the upperstructure by not receiving a supply of a parking release hydraulic fluid when neither the first pilot valve nor the second pilot valve is outputting the pilot hydraulic fluids, and permits a swing of the upperstructure by receiving a supply of the parking release hydraulic fluid when at least one of the first pilot valve and the second pilot valve is outputting the pilot hydraulic fluid,
the pressure sensor includes a parking release pressure sensor that detects a pressure of the parking release hydraulic fluid supplied to the swing brake, and
the controller decides that the pilot hydraulic fluid is being output from the pilot valve in response to the pressure detected by the parking release pressure sensor being equal to or higher than a first threshold.

4. The work machine according to claim 3,
wherein the actuator includes a travel actuator that causes the work machine to travel,
the actuator operation device includes a travel operation device that operates the travel actuator,
the pilot valve includes a travel pilot valve that outputs, to the directional control valve and as an operation signal, the pilot hydraulic fluid according to an operation amount of the travel operation device,
the pressure sensor includes a travel pilot pressure sensor that detects a pressure of the pilot hydraulic fluid output from the travel pilot valve, and
the controller decides that the pilot hydraulic fluid is being output from the pilot valve in response to the pressure detected by the travel pilot pressure sensor being equal to or higher than a second threshold.

5. The work machine according to claim 1, wherein in a case where the controller decides that the pilot hydraulic fluid is output, and switches the lock valve to the lock position, if the lock operation device is operated from the prohibition position to the permission position, and furthermore the lock operation device is operated from the permission position to the prohibition position, the controller switches the lock valve from the lock position to the release position.

6. The work machine according to claim 1, wherein the controller notifies an operator of unintended operation of the actuator operation device in response to a decision that the pilot hydraulic fluid is output.

* * * * *